US011446614B2

(12) United States Patent
Arceneaux et al.

(10) Patent No.: US 11,446,614 B2
(45) Date of Patent: Sep. 20, 2022

(54) WET FRAC-SAND DELIVERY SYSTEM

(71) Applicants: Farrell Arceneaux, Arlington, TX (US); Tommy Monsey, Graham, TX (US)

(72) Inventors: Farrell Arceneaux, Arlington, TX (US); Tommy Monsey, Graham, TX (US)

( * ) Notice: Subject to any disclaimer, the term of this patent is extended or adjusted under 35 U.S.C. 154(b) by 210 days.

(21) Appl. No.: 16/920,092

(22) Filed: Jul. 2, 2020

(65) Prior Publication Data

US 2021/0178345 A1 Jun. 17, 2021

Related U.S. Application Data

(60) Provisional application No. 62/947,685, filed on Dec. 13, 2019, provisional application No. 62/857,147, filed on Jun. 4, 2019.

(51) Int. Cl.

| | |
|---|---|
| ***B01F 23/00*** | (2022.01) |
| ***B01F 23/50*** | (2022.01) |
| ***B01F 35/21*** | (2022.01) |
| ***B01F 35/71*** | (2022.01) |
| *E21B 43/26* | (2006.01) |
| *B01F 101/49* | (2022.01) |

(52) U.S. Cl.

CPC ..... *B01F 23/54* (2022.01); *B01F 35/2134* (2022.01); *B01F 35/21112* (2022.01); *B01F 35/7176* (2022.01); *B01F 2101/49* (2022.01); *E21B 43/2607* (2020.05)

(58) Field of Classification Search

CPC ..... B01F 23/54; B01F 35/7176; B01F 35/21112; B01F 35/2134; B01F 2101/49; E21B 43/267; E21B 43/2607

See application file for complete search history.

(56) References Cited

U.S. PATENT DOCUMENTS

| | | | | |
|---|---|---|---|---|
| 6,167,965 | B1 * | 1/2001 | Bearden | E21B 43/128 417/18 |
| 2006/0144136 | A1 * | 7/2006 | Dutton | E21B 21/062 73/152.32 |

* cited by examiner

*Primary Examiner* — Anshu Bhatia
(74) *Attorney, Agent, or Firm* — Brett Michael Pinkus

(57) ABSTRACT

A wet frac-sand well site delivery system is a process and method of storing, measuring and regulating the percent solids or PPA (pounds of proppant added) in a sand slurry. The wet sand delivery system is a closed loop, on-site storage system that can receive and store wet frac-sand. The wet sand delivery system takes the wet sand directly from the wash plant and transports it to a wet sand storage pit. From the wet sand storage pit, the sand is pumped directly to a blender or regulator for mixing into a sand slurry for subsequent delivery to a frac pump.

13 Claims, 7 Drawing Sheets

WET FRAC-SAND DELIVERY SYSTEM

CROSS-REFERENCE TO RELATED APPLICATIONS

This application is a non-provisional application claiming priority from U.S. Provisional Patent Application No. 62/857,147, filed Jun. 4, 2019, entitled "Wet Frac-Sand Delivery System" and U.S. Provisional Patent Application No. 62/947,685, filed Dec. 13, 2019, entitled "Closed Loop Wet Sand Delivery System", which are incorporated by reference herein.

FIELD

The present disclosure relates to a wet frac-sand well site delivery system.

BACKGROUND

The cost of completing a frac-sand well are substantial. Frac-sand, water and pumping equipment are the three primary cost drivers in well completion. The system described herein is focused on the delivery of wet frac-sand at a well site that reduces the cost of completion for a fracking well.

Frac-sand was once a highly technical classification for sand that had to meet certain material properties. Roundness and hardness were the two most critical specifications. Operators and service companies have become aware that quality is much less important than quantity when maximizing oil well production. This change in thinking is the principal reason for the boom in local and regional frac-sand production. Moreover, this change has been devastating to the sand industry in the northern states but has dramatically reduced the cost of frac-sand delivered to the well. Oil field basins, where sand deposits are present, have quickly become the most economical basins in the United States. Local and regional frac-sand adoption has reduced the cost of sand effectively by 50 percent when compared to railing northern sand to southern basins.

Many operators have unbundled the well completion process and assumed the cost of delivering sand to the well. The conventional process of producing frac-sand typically requires: (1) harvesting a deposit of suitable sand, (2) washing, drying, screening to size, (3) storage and loading trucks at plant, (4) transporting, (5) unloading and storage at well site. Each process, in itself, is fairly straightforward. However, each transition point from harvesting to blender adds cost to the sand and thus the completion.

An operator incurs significant expense for sand that is sized to two grades, 40/70 and 70/140 (100 mesh). For an operator to produce these two grades, the sand is first washed, and, in this process, the large and small grains in the deposit are cut so that the largest is 40 and the smallest is 140. This is done in the washing process so that the resulting sand grains coming from the wash process is 40/140. This column of sand is fed into a dryer and then to a screening tower and finally to dry storage. From dry storage the sand is loaded into a specialized trailer or other customized box delivery system and transported by truck, often times over large distances, to the well site.

SUMMARY

The wet frac-sand delivery system that is disclosed herein is a process and method of storing, measuring and regulating the concentration of solids, or PPA (pounds of proppant added), in a sand slurry. The wet sand delivery system is a closed loop, on-site storage system that can receive and store wet frac-sand. The wet sand delivery system takes the wet sand directly from the wash plant and transports it to a wet sand storage pit. From the wet sand storage pit, the sand is pumped directly to a blender or regulator.

The wet sand delivery system eliminates several high cost steps in the production process. The excluded steps are drying, screening and dry storage. Effectively eliminating three of the five steps, or 60 percent of the process. The production process is limited to the two remaining steps, harvesting and washing. This on-site storage system displaces plant site drying, screening, and dry storage, as well as all dry sand storage and associated equipment on pad site, including, silos, wooden deck storage areas, boxes, pneumatic trailers, sand kings, T-belts, sand conveyors, sand screws, and fork lifts. Accordingly, the total cost savings in the production are substantially reduced, and the reduction of required equipment personnel for operations likewise provide significant savings. Additional benefits of the wet sand delivery system that directly affect cost include zero dust (safety, environmental), no forklifts at the well site, no box or silo storage at the well site, no detention, and smaller pad site (direct cost savings).

BRIEF DESCRIPTION OF THE DRAWINGS

For a more complete understanding of the present disclosure, reference is now made to the following description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The wet frac-sand delivery system utilizes wet sand that has been washed and sized but not dried in a dryer. "Wet Sand" is defined as sand with greater than 3% moisture content. Preferably, the wet sand may between 5% to 8%. The wet sand may be a courser grade frac-sand, such as 40/140 (heavy 100 mesh) which has been adopted by several operators in the Permian Basin and in the Haynesville Shale Basin, with excellent results. In some cases, operators are experiencing substantially better results due to the ability to pump more sand per stage at a lower cost. The frac-sand may also be finer grade, such as 40/70 and 70/140 (100 mesh).

Figure 1:
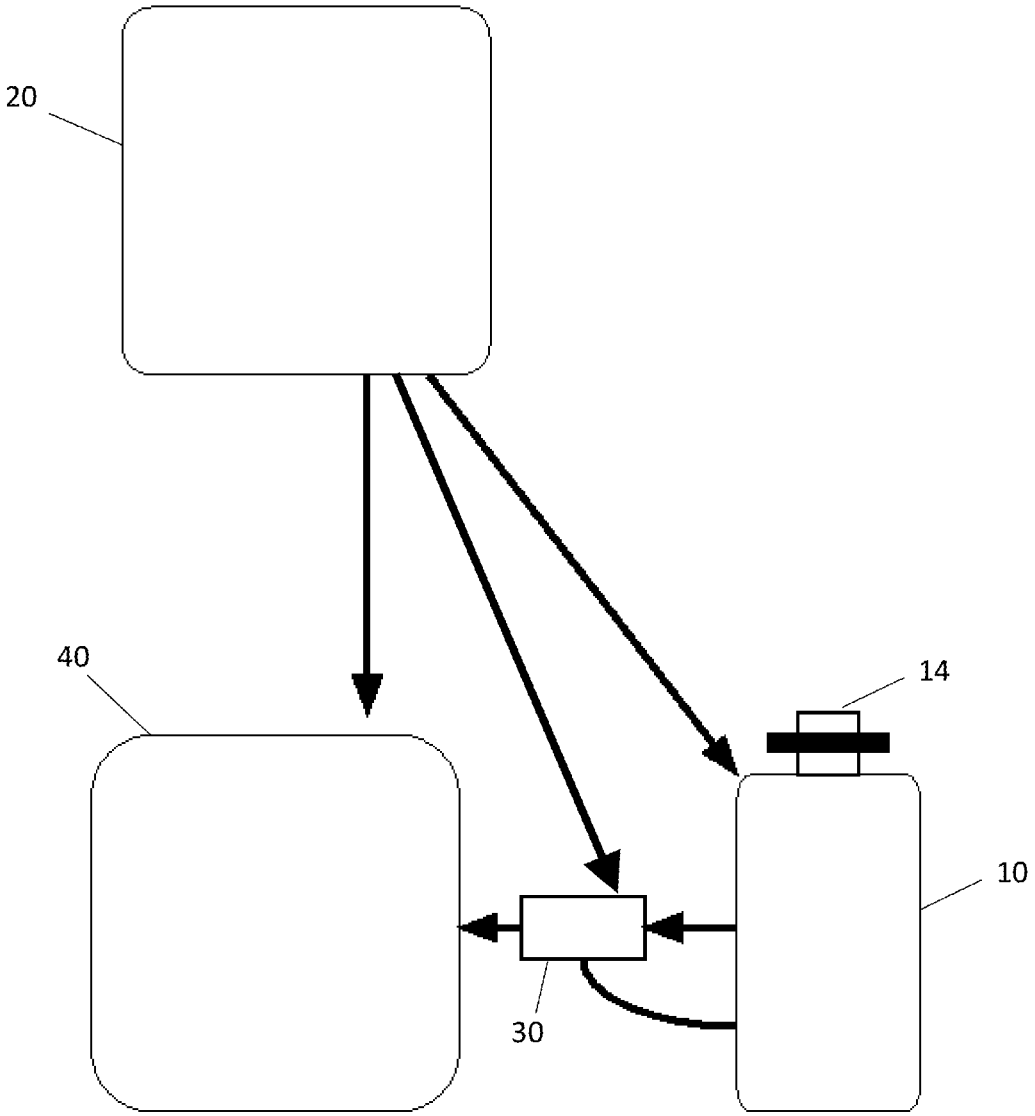
FIG. 1 is a diagram of a wet frac-sand delivery system according to one embodiment.
Figure 2:
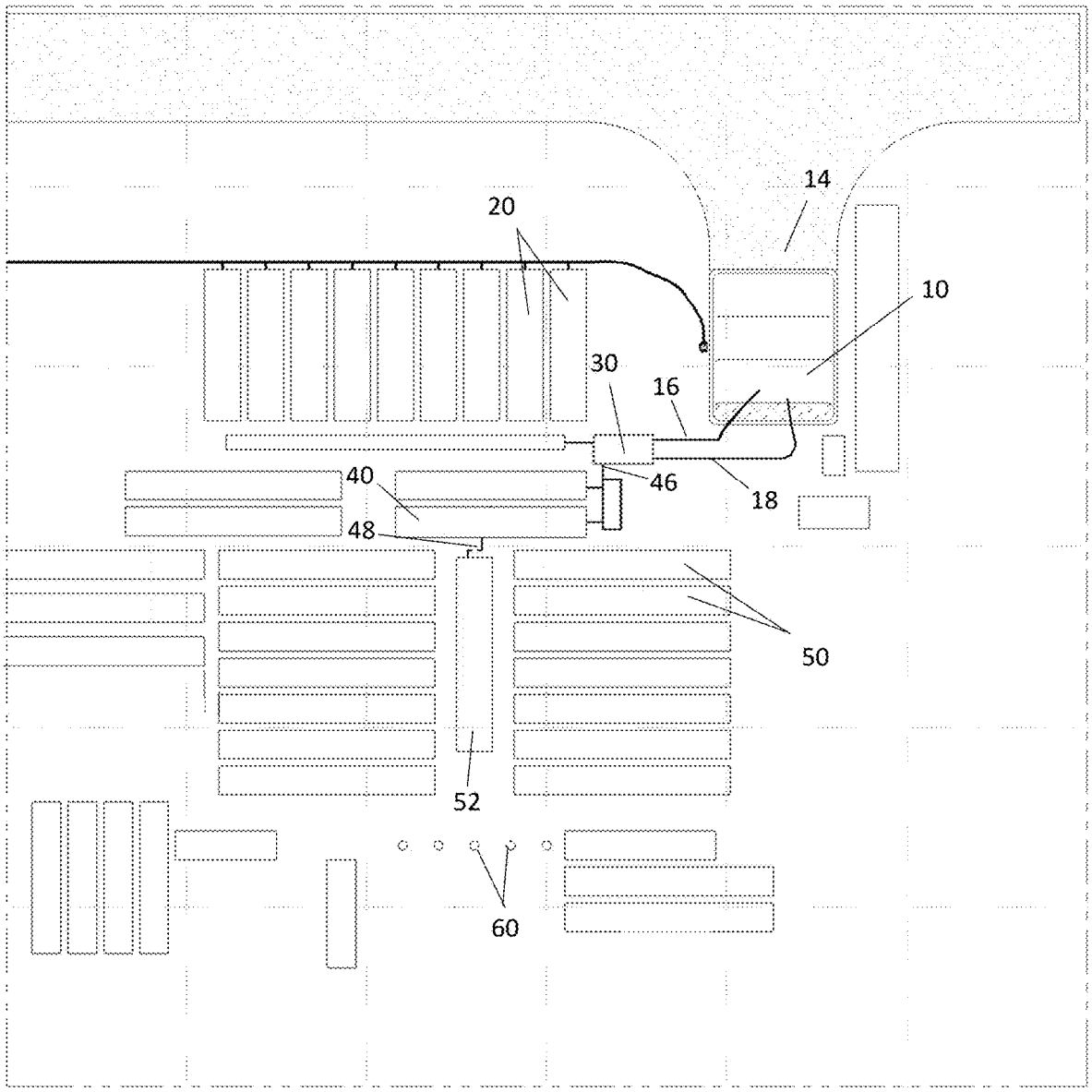
FIG. 2 is a plan view of a well site including a wet frac-sand delivery system according to the embodiment in FIG. 1.

According to an embodiment depicted in FIG. 1, the wet frac-sand delivery system comprises a wet sand storage pit 10, a water pit or tanks 20, a wet sand regulator 30, and a blender 40 at the pad site. A more detailed view of the site layout is shown in FIG. 2. Wet sand is transported directly from a wash plant to the wet sand storage pit 10 on site. The wet sand is then pumped by a source pump 12 within the sand storage pit 10 via a pipe 14 to the wet sand regulator 30. The wet sand regulator 30 delivers the wet sand via a pipe 46 to the blender 40. Water may be delivered from the water tanks 20 to the wet sand regulator 30 and/or directly to the blender 40 to be added to wet sand. The flow, rate, and density of sand and water delivery to the blender 40 is controlled by the wet sand regulator 30 to form a sand slurry with the appropriate PPA concentration. Chemical additives may be added to the sand slurry within the blender 40. The blender 40 then provides the sand slurry (directly or indirectly, such as through a manifold 52) to the frac pumps 50 via a supply line 48 to be discharged to the well head 60.

Figure 3A:
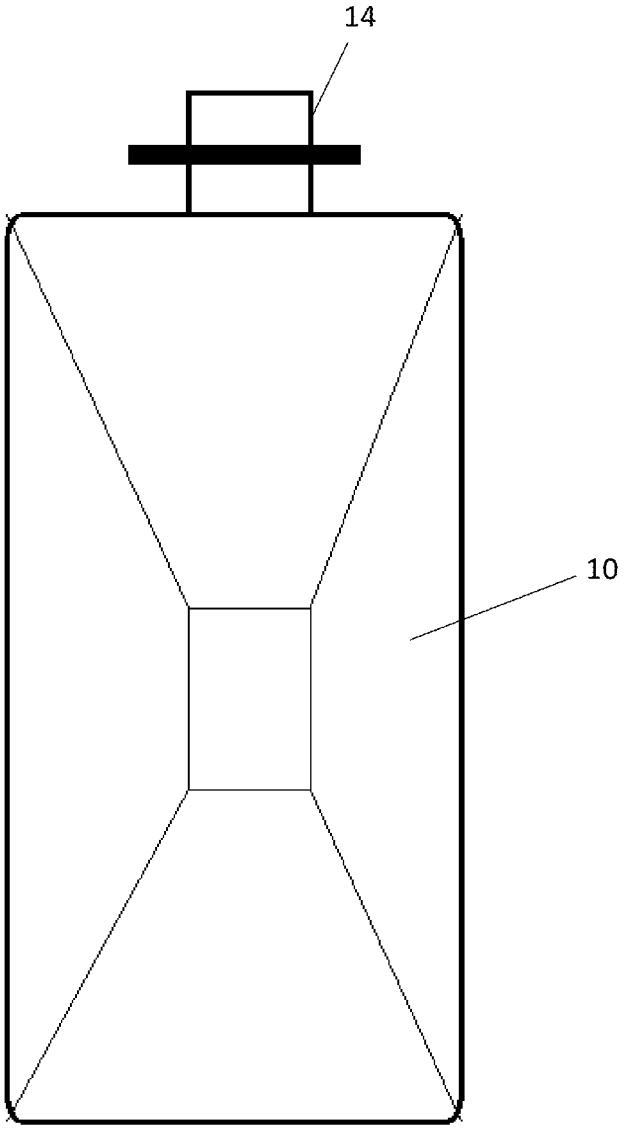
FIGS. 3A and 3B are a plan view and cross-section view of a wet sand pit according to one embodiment.
Figure 3B:
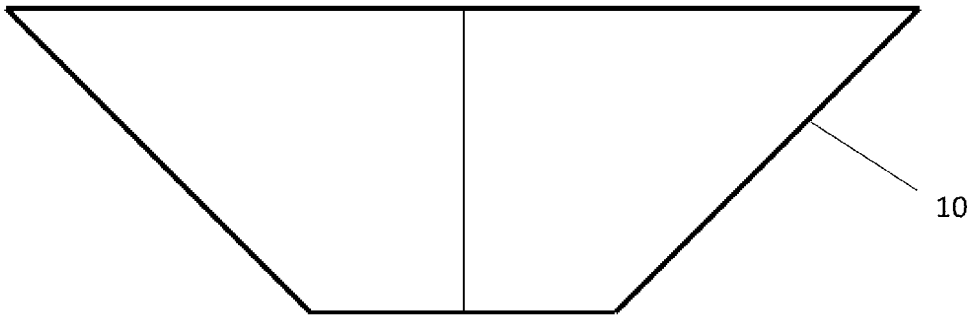
Figure 7A:
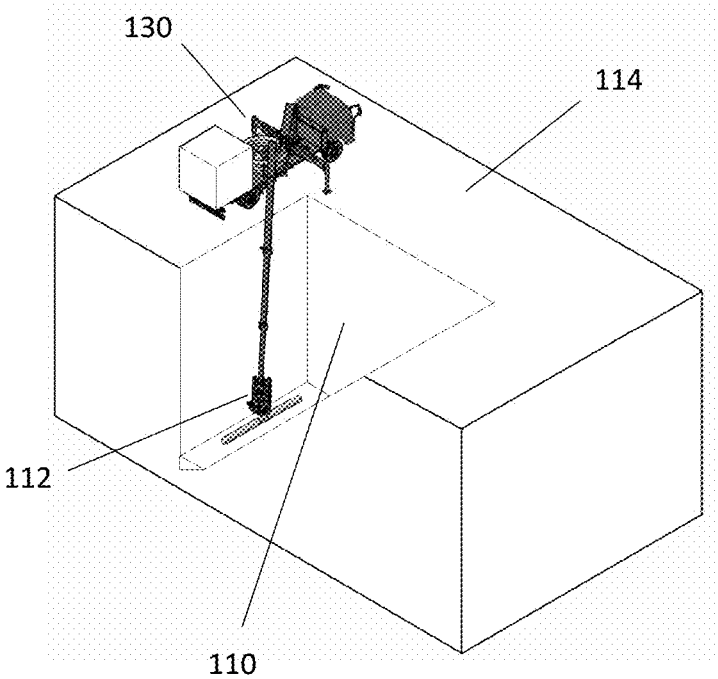
FIGS. 7A and 7B are an isometric view and cross-section view of a wet sand pit according to one embodiment.
Figure 7B:
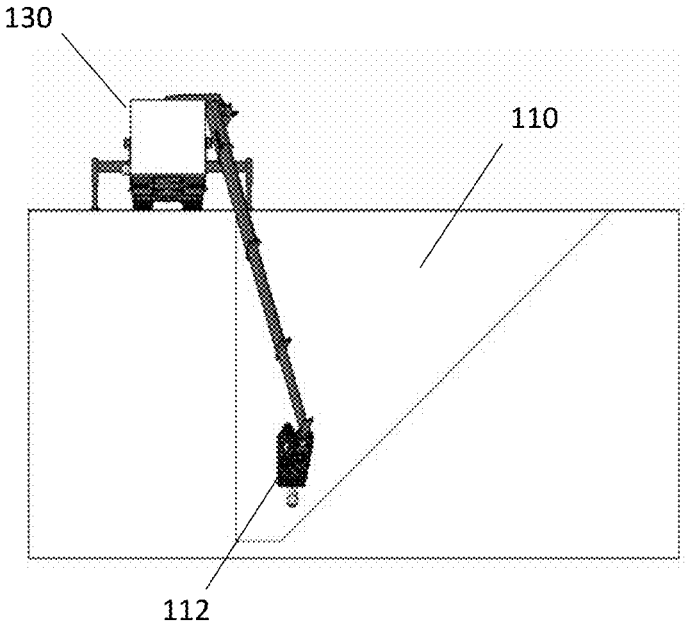

The wet sand storage pit 10 may be a lined earthen pit. The sand, wet or dry, will be delivered and stored in the lined pit, eliminating the need for specialized storage. The wet sand storage pit 10 may be formed in an advantageous shape for funneling the sand downward toward the center of the pit, such as an inverted cone like shape as shown in FIGS. 3A and 3B or half inverted cone like shape such as shown in FIGS. 7A and 7B. Preferably, the lined pit may hold 2 to 3 million pounds of sand and 5 to 8 million gallons of water, but may be larger or smaller depending on job specs.

The wet sand storage pit 10 will reduce off load times at the pad site. Currently dry sand is transported by specialized pneumatic trailers or boxes. The pneumatic trailers use pressure to blow the load of dry sand into upright silos on site. The process takes as much as 45 minutes to off load dry sand. This is a substantial cost of transportation and effects the number of loads a truck can deliver in a 12-hour period. The storage box systems are more efficient to off load but require forklifts and other specialized conveyors. Additionally, the box and silo systems require annual leases that are very expensive to service companies. However, the wet sand storage pit 10 may enable side or belly dump trailers to dump directly into the pit at a truck of load site 14. This change in delivery trailer reduces off-load time, for example, taking less than 10 minutes. The time savings in off-loading will save on costs associated with pneumatic trailers. For example, reducing the off-load time by 30 minutes may provide savings of 20 to 30 percent of cost associated with pneumatic trailers. With regard to box storage systems, the closed loop system eliminates lease, forklift and custom trailer cost. Savings compared to box systems will be substantial, and may exceed 50 percent.

The wet sand storage pit 10 may be centrally located to support multiple wells that may be placed on a section of land. For example, in the Delaware Basin, operators are placing as many as four 12-well pads on one section of land. Centrally locating the wet sand pit in the center of the section of the pad site would allow this single pit to support up to 50 well completions. This system will allow exploration and production operators in areas with multiple pay zones and multi-well pads to build water and sand pits that services as many as 10 to 100 well completions.

Figure 4A:
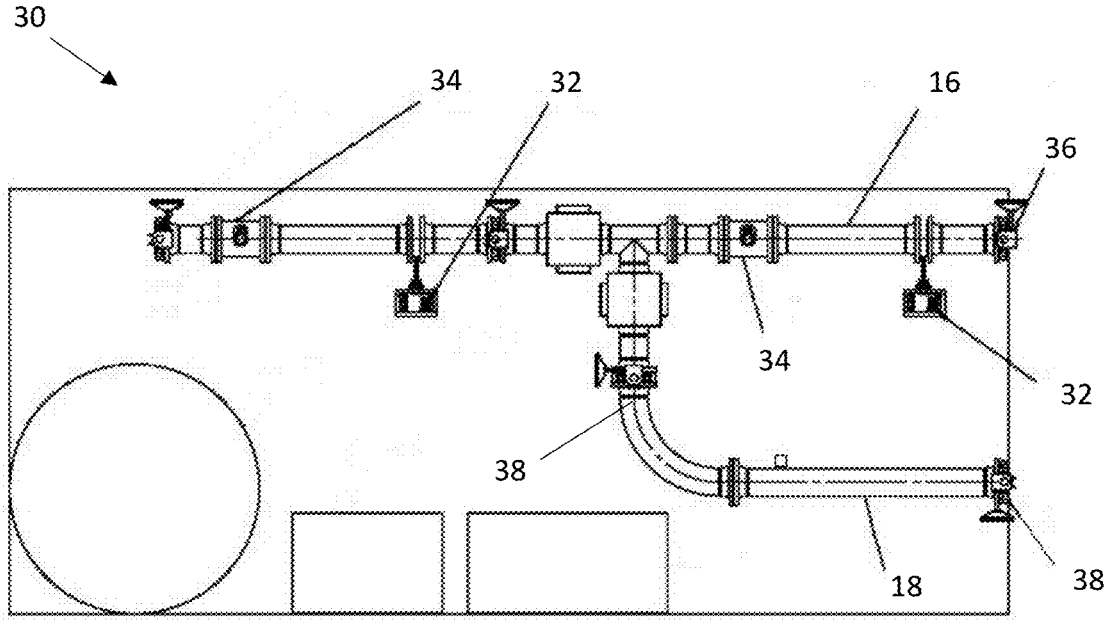
FIGS. 4A and 4B are a plan view and an isometric view of a wet sand regulator according to one embodiment.
Figure 4B:
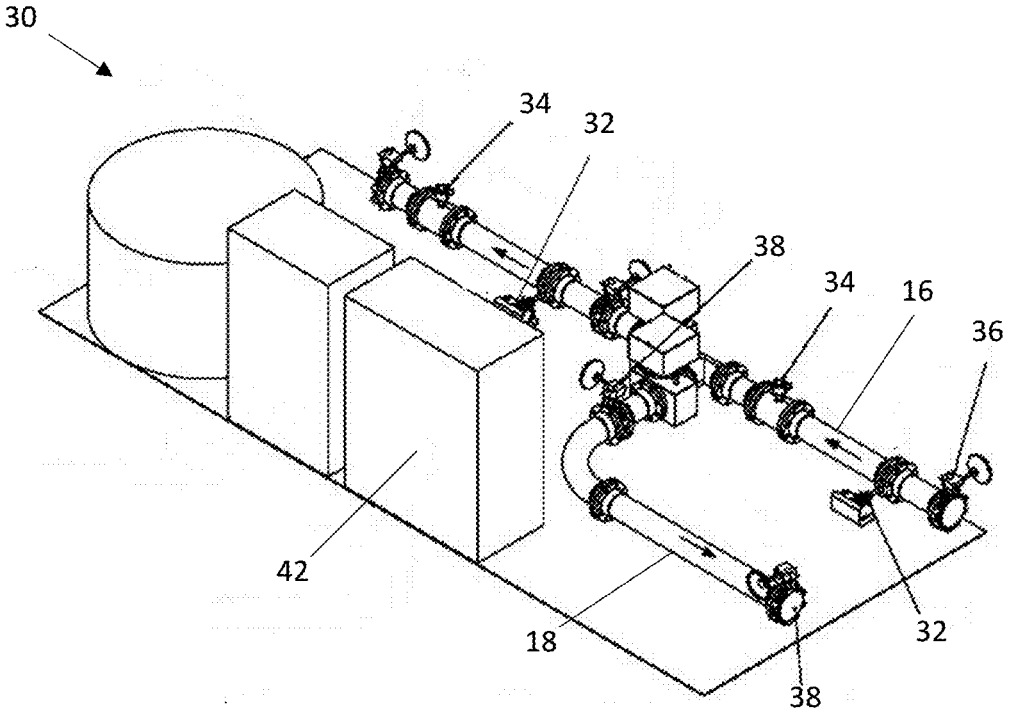

The wet sand regulator 30, an embodiment of which is shown in FIGS. 4A and 4B, regulates the amount of sand per gallon of water delivered to the blender 40 by managing the flow and rate, and density of sand and water to the blender 40. The wet sand regulator 30 may communicate electronically, through control logic, with the blender 40 to deliver sand as needed in the desired downhole rate and concentration of sand that is desired. The wet sand regulator 30 monitors the pounds of sand per gallon of water circulating from the sand pit. The wet sand regulator 30 may include a density meter 32, flow meter 34, flow rate sensor, and other sensors that monitor data, including but not limited to, Density Dredge Line (PPA), Flow Rate Dredge Line (BPM), Density to Blender (PPA), Flow Rate To Blender (BPM), Total Sand pumped per Stage (lbs), Total Sand Pumped (lbs), Water pumped per Stage (BBL), Total Water Pumped (BBL), Inputted Downhole Rate (BPM), Desired Downhole Density (PPA), Slurry per Stage Pumped (BBL), Total Slurry Pumped (BBL), and Sand Specific Gravity.

The data collected by the wet sand regulator 30 is then sent to a control panel 42 and/or computer. The control panel may use control logic to calculate from this data the volumetric ratio per unit time (GPM, BPM, etc.) of clean water to dirty water required to be sent to the blender tub in order to dilute the slurry to the desired PPA value. Further, using a real time density reading, the control panel may determine how much flow is needed to provide the desired amount of sand to the blender, and open a supply valve 36 on a line delivering sand to the blender 40 and close return valves 38 on a return line to the pit wet sand pit 10 accordingly to achieve necessary rate to the tub. For example, the valves 36 and 38 may be pinch valves, butterfly valves and/or other suitable valves. The wet sand regulator 30 may be capable of delivering dirty water to the blender 40 at a high rate of accuracy. For example, the wet sand regulator may allow the blender tub to be able to produce a range of 0.5 to 2 lbs of sand per gallon of water at a rate up to 100 BBL per minute.

The wet sand regulator 30 may be mobile, such as by mounting the regulator on a skid, or it may be installed as stationary equipment at the well site.

Figure 5:
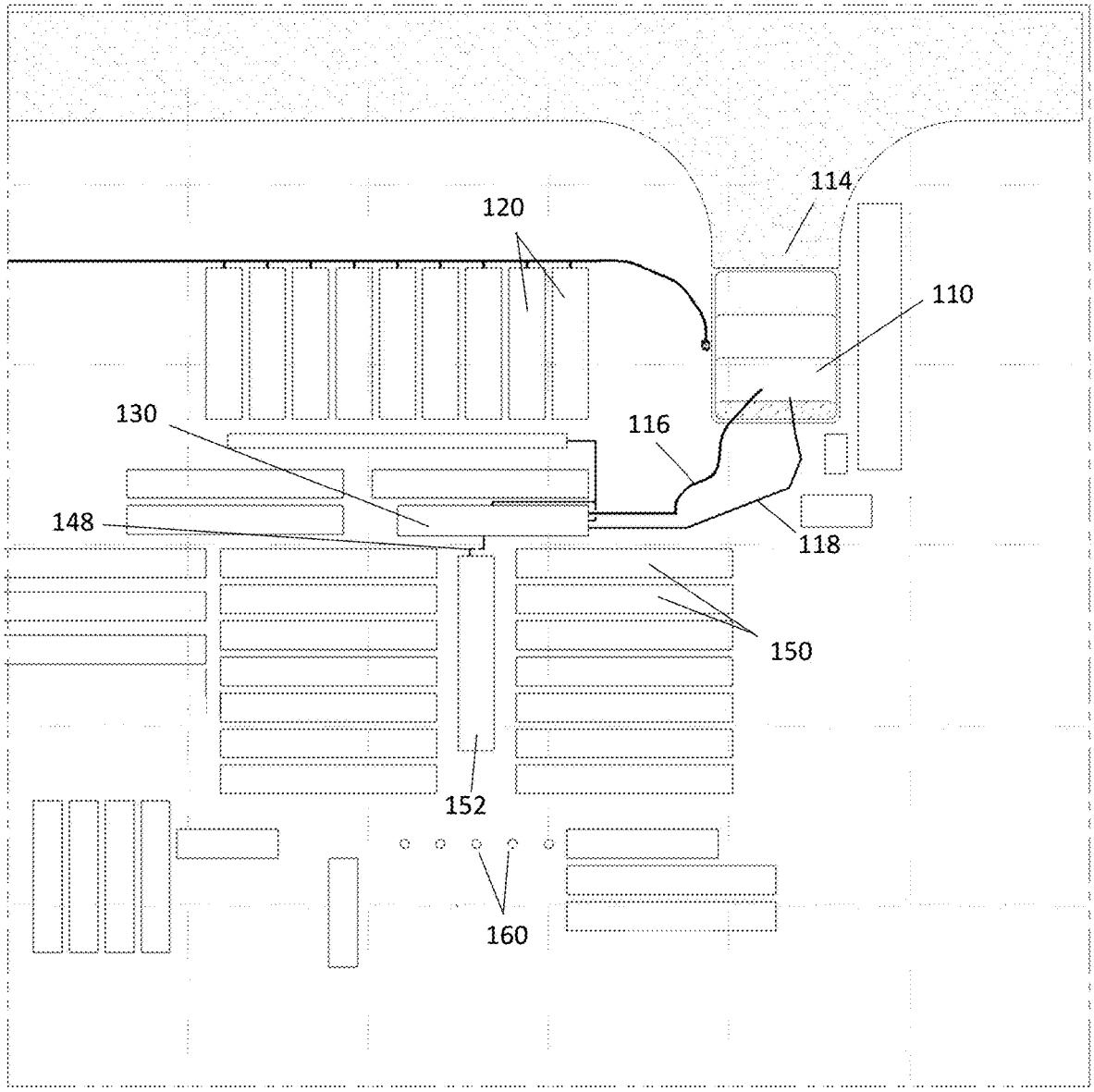
FIG. 5 is a plan view of a well site including a wet frac-sand delivery system according to another the embodiment.

According to another embodiment depicted in the site layout in FIG. 5, a wet frac-sand delivery system comprises a wet sand storage pit 110, a source pump 120, and a sand slurry regulator 130. Water and sand slurry from the wet sand storage pit 110 are pumped by the source pump 120 to the sand slurry regulator 130, where density (PPA) and flow rate (BBM) are regulated to meet the requirements of the customer's frac design. The source pump 120 may be a submersible C-pump, which may be situated below the water surface at or near the pit bottom of the wet sand storage pit 110. For example, the pump may be situated 15 to 20 feet below water surface. In this embodiment, the sand slurry regulator 130 is used in place of the blender and wet sand regulator in the embodiment of FIG. 1, and serves to meter and regulate the percent solids or PPA in the slurry of sand and water in a similar manner.

Figure 6A:
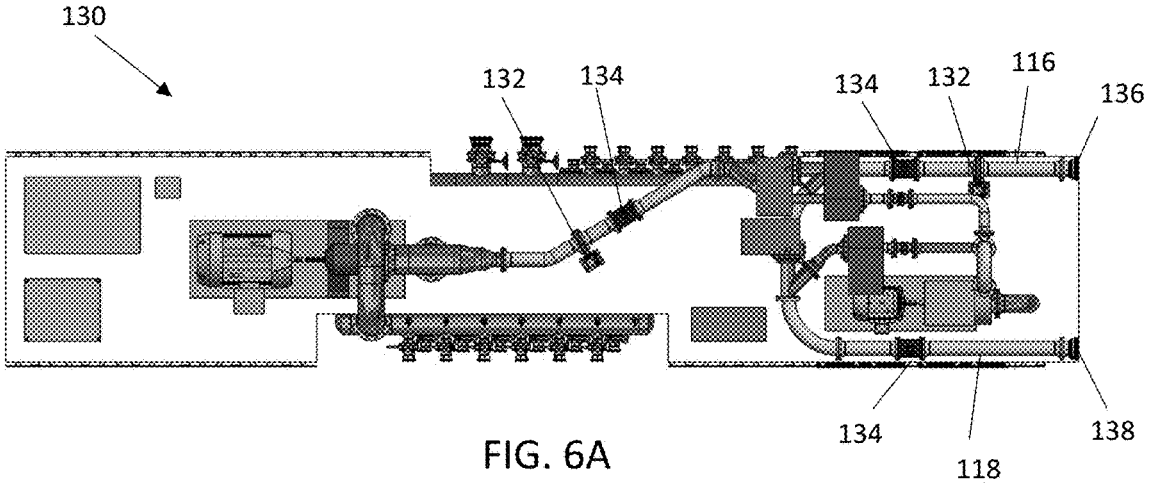
FIGS. 6A and 6B are a plan view and a side view of a wet sand regulator according to another embodiment.
Figure 6B:
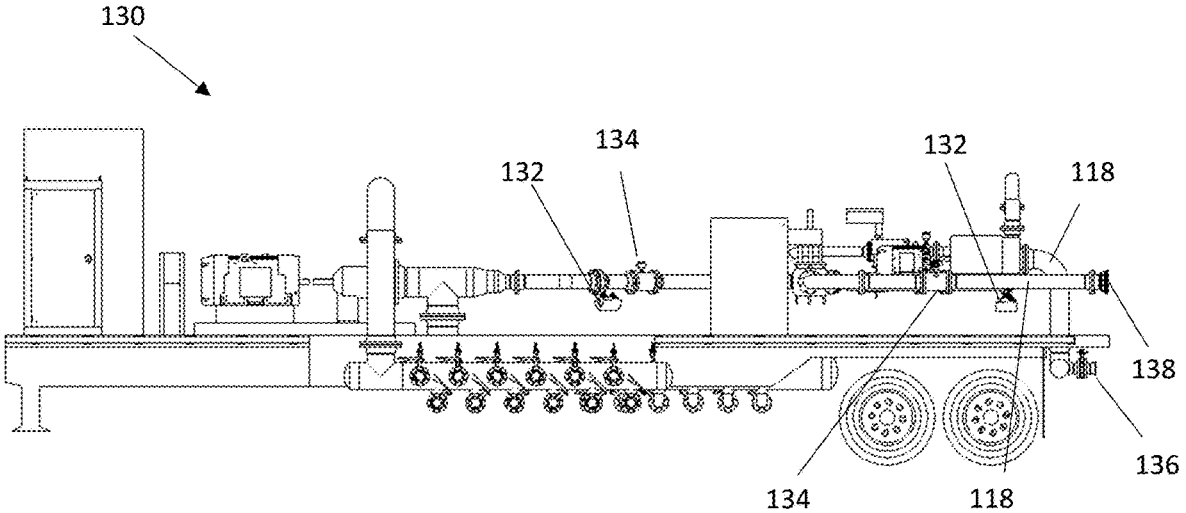

The sand slurry regulator 130, an embodiment of which is depicted in FIG. 6A-6B, receives a homogenous sand slurry from the source pump and recirculate the slurry back to the wet sand storage pit 110. Water may be delivered from the water tanks 120 to the sand slurry regulator 130 and/or to the wet sand storage pit 110 to be added to the slurry, and the flow and rate of water may be adjusted by the sand slurry regulator 130 to achieve the desired PPA concentration. Chemical additives may also be added to the sand slurry within the sand slurry regulator 130. The PPA in the recirculating slurry may be measured, for example, by high frequency ultrasonic density meters 132. Once originating PPA is established, supply valve 136 and return valve 138 will open and close allowing the appropriate PPA to be delivered directly or indirectly to the frac pumps 150 via a supply line 148 (directly or indirectly, such as through a manifold 152) to be discharged to the well head 160, and the balance of the slurry will recirculate back to the storage pit via a return line 118. For example, the valves 136 and 138 may be pinch valves, butterfly valves and/or other suitable valves. Preferably, the delivered PPA ranges from 0.25 to 2 lbs/gal, and the rates range from 50 to 100 BPM. The flow and rate of the slurry may be measured by flow meters 134, and the valves 136, 138 can be adjusted to achieve a desired flow of flurry to be delivered to the frac pumps 150.

The sand slurry regulator 130 may be mobile, such as by mounting the regulator on a skid, or it may be installed as stationary equipment at the well site.

Current frac sand systems originate a sand slurry in an open top tub where sand and water are combined prior to being pumped to the missile. The blender tub agitates the slurry with paddles as sand is added into the tub. This process allows air bubbles to be captured in the slurry. When the air bubbles are exposed to the high-pressure pumps, microscopic explosions occur causing cavitation damage to pump fluid ends, which is a known industry issue. The wet sand delivery system addresses the air and cavitation issue by originating the sand slurry with the submersible pump 120, which is situated below the water surface level of the wet sand storage pit 110. Air will not be introduced at origination of the slurry due to the pumps submerged depth at origination, which will dramatically increase fluid end duty cycles.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Additionally, other items shown or discussed as being in direct connection with each other may be indirectly connected or communicating through some interface, device, or intermediate component, whether mechanically, electronically, or otherwise. Other examples of changes, substitutions, and alterations are ascertainable by one skilled in the art and could be made without departing from the spirit and scope disclosed herein.

What is claimed is:

1. A wet-frac sand delivery system comprising:
a tank for storing wet sand;
a sand slurry regulator comprising:
a supply line for receiving wet sand from the pit,
a return line to return wet sand to the pit,
a flow meter,
a density meter, and
a delivery line for delivering wet sand slurry;
a source pump which pumps wet sand from the pit to the sand slurry regulator through the supply line;
a blender for mixing the wet sand slurry; and
wherein the sand slurry regulator monitors at least one of the flow and density of the wet sand slurry and adjusts at least one of the flow and density to deliver wet sand slurry through the delivery line to the blender with a desired concentration of solids,
wherein the wet sand slurry is fed from the blender to one or more frac pumps.

2. The wet-frac sand delivery system of claim 1, wherein the source pump is a suction pump with a suction intake situated at the base of the pit.

3. The wet-frac sand delivery system of claim 1, further comprising a water line for supplying water to the sand slurry regulator.

4. The wet-frac sand delivery system of claim 1, further comprising a water line for supplying water to the pit.

5. The wet-frac sand delivery system of claim 1, wherein the tank is a lined earthen pit or a storage tank.

6. The wet-frac sand delivery system of claim 1, wherein the density of the wet sand slurry can be adjusted by a water source that provides water to at least one of the following:
the tank for storing wet sand,
the source pump,
the sand slurry regulator, and
the blender.

7. The wet-frac sand delivery system of claim 1, wherein the wet sand regulator further comprises a manifold, and wherein the wet sand slurry is delivered from the sand slurry regulator to the blender or directly to the manifold which delivers the wet sand slurry to the frac pumps.

8. A wet-frac sand delivery system comprising:
a tank for storing wet sand;
a sand slurry regulator comprising:
a supply line for receiving wet sand from the pit,
a return line to return wet sand to the pit,
a flow meter,
a density meter, and
a delivery line for delivering wet sand slurry;
a source pump which pumps wet sand from the pit to the sand slurry regulator through the supply line,
a manifold for feeding wet sand slurry to one or more frac pumps;
wherein the sand slurry regulator monitors at least one of the flow and density of the wet sand slurry and adjusts at least one of the flow and density to deliver the wet sand slurry with a desired concentration of solids through the delivery line to the manifold.

9. The wet-frac sand delivery system of claim 8, wherein the source pump is a suction pump with a suction intake situated at the base of the pit.

10. The wet-frac sand delivery system of claim 8, further comprising a water line for supplying water to the sand slurry regulator.

11. The wet-frac sand delivery system of claim 8, further comprising a water line for supplying water to the pit.

12. The wet-frac sand delivery system of claim 8, wherein the tank is a lined earthen pit or a storage tank.

13. The wet-frac sand delivery system of claim 8, wherein the density of the wet sand slurry can be adjusted by a water source that provides water to one or more of the following:
the tank for storing wet sand,
the source pump, or
the sand slurry regulator.

* * * * *